United States Patent [19]

Williams

[11] Patent Number: 4,648,815

[45] Date of Patent: Mar. 10, 1987

[54] ROTARY AIR COMPRESSOR WITH THERMALLY RESPONSIVE OIL INJECTION

[75] Inventor: Michael R. Williams, West Midlands, England

[73] Assignee: The Hydrovane Compressor Company Limited, Redditch, England

[21] Appl. No.: 772,886

[22] Filed: Sep. 5, 1985

[30] Foreign Application Priority Data

Sep. 5, 1984 [GB] United Kingdom ..... 8422422

[51] Int. Cl.[4] ..... F04C 29/02; F01M 5/00; B01D 50/00

[52] U.S. Cl. ..... 418/84; 418/85; 418/87; 418/97; 418/99; 418/DIG. 1; 55/330; 55/332; 184/6.22

[58] Field of Search ..... 418/84, 85, 87, 97–99, 418/DIG. 1; 184/6.16, 6.22, 104.1; 55/330, 332

[56] References Cited

U.S. PATENT DOCUMENTS

| | | | |
|---|---|---|---|
| 1,558,620 | 10/1925 | Kagi | 418/97 |
| 1,854,692 | 4/1932 | Cooper | 418/DIG. 1 |
| 3,669,579 | 6/1972 | Carter | 418/85 |
| 3,768,236 | 10/1973 | Rudge . | |
| 3,876,345 | 4/1975 | Froede et al. | 418/84 |
| 3,945,464 | 3/1976 | Sato | 418/85 |
| 4,011,032 | 3/1977 | Steinwart et al. | 418/84 |
| 4,388,046 | 6/1983 | Boller . | |
| 4,441,871 | 4/1984 | Boller . | |
| 4,553,906 | 11/1985 | Boller et al. . | |

FOREIGN PATENT DOCUMENTS

| | | | |
|---|---|---|---|
| 0067949 | 5/1982 | European Pat. Off. . | |
| 139367 | 12/1979 | German Democratic Rep. | 418/97 |
| 55-98688 | 7/1980 | Japan | 418/DIG. 1 |
| 1134224 | 11/1968 | United Kingdom . | |

*Primary Examiner*—John J. Vrablik

*Attorney, Agent, or Firm*—Cushman, Darby & Cushman

[57] ABSTRACT

A rotary air compressor of oil sealed type includes a stator containing a rotor, oil injectors arranged to inject oil into the interior of the stator, an oil sump connected by a first oil pathway to the oil injectors and an oil cooler situated in the first oil pathway. A thermally responsive valve situated in the first oil pathway is arranged to open only when the temperature of the oil has reached a predetermined value whereby no oil is injected through the oil injectors before the temperature of the oil has reached the said predetermined value.

4 Claims, 3 Drawing Figures

ROTARY AIR COMPRESSOR WITH THERMALLY RESPONSIVE OIL INJECTION

The present invention relates to rotary air compressors of oil sealed type and more particularly of eccentric rotor sliding vane type. The term oil sealed compressor is used herein to denote those compressors in which oil is injected into the compression space and is subsequently removed from the compressed air and recycled.

Eccentric rotor sliding vane compressors comprise a rotor which is eccentrically mounted in a stator and in which a plurality of equispaced radial slots are formed. The slots slidably accommodate respective vanes which divide the crescent shaped working space defined by the stator and the rotor into individual compression cells. As the rotor is rotated the volume of each compression cell gradually increases to a maximum and then decreases again to a value approaching zero. An inlet passage passes through one of the end plates closing the stator and generally communicates with a recess formed on the inner surface of the end plate and extending over an angular extent which corresponds to that over which the volume of the compression cells increases. One or more outlet passages formed in the stator are positioned to communicate with each compression cell sequentially shortly before its volume reaches its minimum value. Thus, in use, air enters each compression cell whilst its volume is increasing and is then compressed as the volume of the cell decreases and then flows out through the outlet when the cell has moved round to the appropriate position.

A typical compressor of the type referred to above is disclosed in British Patent No. 1134224. In such compressors the rotor/stator unit is accommodated in an outer housing, the lower portion of which constitutes a sump and contains oil.

In use, oil is injected into the compression space to lubricate the vanes, to ensure that the vanes form a reliable seal with the stator and with the end plates closing the stator and to remove the majority of the heat produced by the compression to which the air is subjected. The oil is entrained in the compressed air in the form of droplets and passes out through the stator outlets with the compressed air. The oil is then removed from the compressed air, typically in two stages, the first of which comprises a tortuous path or one or more surfaces within the outer casing which cause the majority of the entrained oil droplets to coalesce and then run down into the pool of oil in the sump. The second separation stage generally comprises one or more filters or coalescing elements disposed in a separate housing connected to the outer compressor casing in which the remaining oil droplets are removed from the compressed air and then returned for reuse.

One problem that persistently arises in air compressors is that of condensation. At the high pressures, typically 7 bar or 10 bar, which prevail within such compressors the dew point of air is typically 60° C. This is no problem when the compressor is in continuous operation since such compressors operate at temperatures above 60° but when the compressor is started up from cold, there is a tendency initially for condensation to form within the compressor. This condensation evaporates if the compressor is subsequently operated for an extended period of time but if the compressor is intermittently operated for a short period of time condensation may progressively accumulate within the compressor. Thus can lead to various problems but having regard to the fact that oil floats on water it is possible for water to be injected into the stator rather than oil which can result in the whole compressor seizing up.

Whilst this problem can not be completely eliminated it can be minimised by ensuring that the compressor reaches its normal working temperature as rapidly as possible. The oil that is injected into the stator is generally withdrawn from a sump defined by the outer casing of the compressor by the pressure differential that exists within the compressor and passed through an oil cooler before being so injected. Whilst the cooler is desirable when the compressor is at its normal operating temperature it does of course tend to increase the time taken for the compressor initially to each its working temperature.

It is therefore known to provide the oil cooler with a thermally actuated bypass valve which only connects the cooler into the oil circuit once the temperature of the compressor has reached its normal working value. Whilst this certainly increases the speed with which the compressor heats up, it is believed not to represent the optimum solution to this particular problem. The reason for this is that even when a thermal bypass valve is provided the work done by the compressor motor must still heat not only the metal components of the compressor but all the oil to the working temperature of the compressor and it will be appreciated that the latter constitutes a significant proportion of the total thermal mass of the compressor. In addition, the oil pathway is generally remote from the air pathway and it is of course the air pathway that requires to be heated to about 60° C. as rapidly as possible in order to prevent condensation from forming.

Accordingly, it is an object of the present invention to provide an oil sealed rotary compressor which will warm up to its normal operating temperature more rapidly than known compressors and in which the heat generated is preferably directly preferentially to the air pathway rather than the oil pathway, at least in the initial warm up stage of operation.

According to the present invention, a rotary air compressor of oil sealed type includes a stator containing a rotor, one or more oil injection means arranged, in use, to inject oil into the interior of the stator, an oil sump connected by a first oil pathway to the oil injection means, an oil cooler situated in the first oil pathway, and a thermally responsive valve situated in the first oil pathway and arranged to open only when the temperature of the oil has reached a predetermined value.

When the compressor is started, the temperature of the oil is less than the predetermined value, and thus no oil at all is injected through the oil injection means but this does not adversely affect the operation of the compressor since the primary purpose of the oil injected through the oil injection means is to cool the rotor and stator and such cooling is not required when the compressor is initially started, that is to say before it has reached its normal working temperature. The oil injected into the stator also has the subsidiary purposes of lubricating the compression elements and forming a reliable seal between the compression elements or between the compression elements and the stator, but very little oil is required for this purpose, and in practice there is generally sufficient residual oil in the stator to effect the lubrication and sealing functions for a considerable length of time, and before this time elapses the temperature will in any event have reached the predetermined value and the thermally actuated valve will have opened thereby initiating injection of oil through the oil injection means.

It will however be appreciated that the compressor may include components which require constant lubrication and which thus cannot operate throughout the warm-up phase without such lubrication. In a preferred embodiment of the invention, the compressor is of eccentric rotor sliding vane type, the two ends of the stator being closed by respective end plates in which a respective aperture is formed in which the rotor is supported by respective bearings, the compressor including a second oil pathway extending from the sump to one or both of the bearings and/or the inner surface of one or both of the end plates, the second oil pathway being constructed and arranged to permit the flow of oil therethrough substantially as soon as the compressor is started. In conventional eccentric rotor sliding vane compressors, there is an oil supply line to each of the rotor bearings, and each of the end plates, but it is preferred that a single second oil pathway is provided at each end of the stator which supplies oil both to the associated bearing, and the associated end plate. The oil that is supplied to the end plates will of course augment the residual oil present in the stator, and assist in the lubrication and sealing functions. The oil may be withdrawn from the sump by a pump, but it is preferred that the oil circulation is effected solely by the pressure differentials existing, in use, within the compressor.

Thus, when the compressor is started up, no oil is injected through the oil injection means, and substantially all the heat generated by the compression goes into heating the rotor and stator, and the air which is compressed together with the small amount of oil which is entrained therein. The rotor and stator, and the air pathway on the discharge side of the stator thus heat up more rapidly than is usual, and it will be appreciated that, at least initially, the oil in the sump is heated relatively slowly.

In the most preferred embodiment the stator is accommodated within an outer casing which defines the oil sump and the compressor further includes primary and secondary oil separation means for removing substantially all the entrained oil from the compressed air, the primary separation means including one or more surfaces against which the compressed air leaving the stator is constrained to impinge whereby a proportion of the oil droplets are caused to coalesce and then drip downwardly towards the sump, the secondary separation means including one or more coalescing elements through which the compressed air is constrained to pass whereby substantially the remainder of the entrained oil droplets are caused to coalesce, the coalescing element or elements being accommodated within a secondary separation housing which is arranged below at least a part of the primary separation means and so situated that at least a proportion of the oil coalesced by the primary separation means runs down over the outer surface of the secondary separation housing.

Thus, in use, when the compressor is started up, the major proportion of the hot oil droplets entrained in the compressed air is coalesced by the primary separation means, and then directed to run down over the surface of the secondary separation housing. The oil gives out a substantial amount of heat to the secondary separation housing thereby ensuring that the secondary separation means and a considerable proportion of the compressed air pathway within the compressor are rapidly heated up to their working temperature. This heat transfer is effected very much more efficiently by the oil than would be the case with air, since oil has a far greater thermal capacity than air. The oil which initially reaches the sump has already been substantially cooled and the heat generated within the stator is thus preferentially directed to the compressed air pathway rather than to the oil thus maximising the rate at which the compressed air pathway is heated up, and minimising the risk of formation of condensation.

In one embodiment the primary separation means includes an annular primary separation chamber extending around the secondary separation housing. The primary separation chamber may partially be defined by an annular baffle plate, extending around, but not necessarily connected to the secondary separation housing. The compressor may include a discharge pipe arranged to direct compressed air from the stator into the primary separation chamber, and a further pipe arranged to direct compressed air to the secondary separation means and having an open end on the side of the annular baffle plate remote from the primary separation chamber. It will be appreciated that this latter feature requires that the compressed air pass from one side of the baffle plate to the other, and this may occur by reason of a clearance provided between the baffle plate and the secondary separation housing, but it is preferred that alternatively, or in addition, the annular baffle plate has one or more apertures in it which are circumferentially offset from the discharge pipe.

Further features and details of the present invention will be apparent from the following description of one specific embodiment which is given by way of example only with reference to the accompanying drawings, in which.

Figure 1:
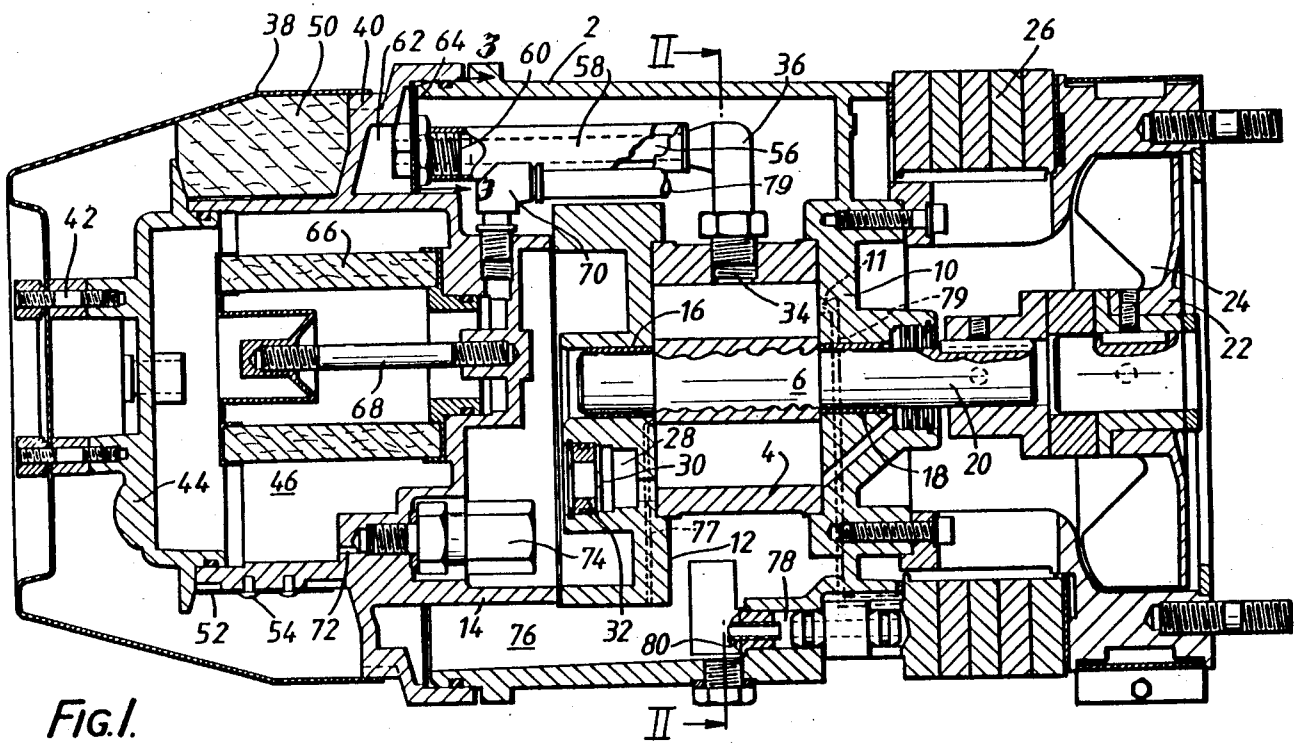
FIG. 1 is a longitudinal sectional elevation of a compressor in accordance with the invention.
Figure 3:
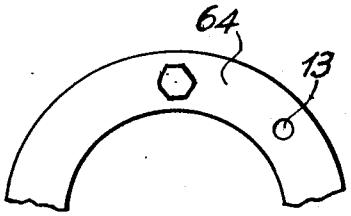
FIG. 3 is a view along lines 3—3 of FIG. 1.
Figure 2:
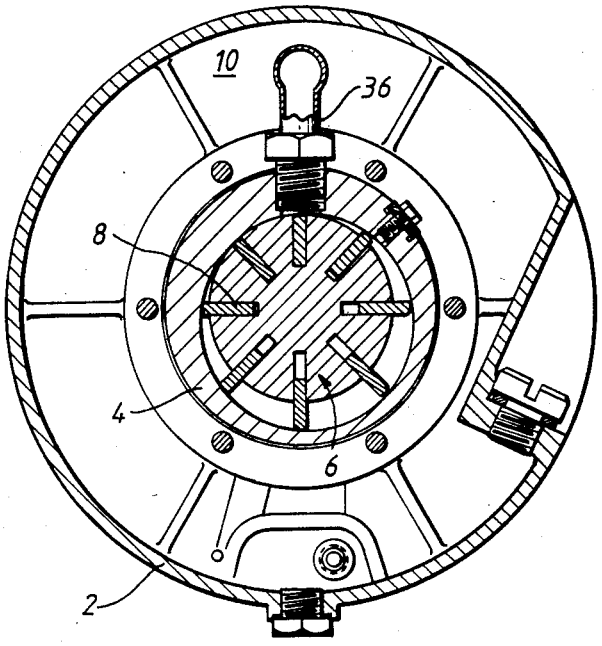
FIG. 2 is a transverse sectional view on the line II—II in FIG. 1.

The compressor includes an outer casing 2 which is an aluminium casting and contains a stator 4. Eccentrically rotatably mounted within the stator is a rotor 6 which affords a plurality, in this case 8, equi-spaced radial slots each of which accommodates a respective sliding vane 8. The rotor and stator together define a crescent-shaped working space which is divided up into working cells in the usual manner by the vanes. The two ends of the stator are closed by two end plates, one of which is designated 10 and is integral with the outer casing and the other of which is designated 12 and is retained in position by a separator casting 14, which will be described in more detail below. The end plate 12 has a hole formed therein which accommodates a bearing 16 which supports a stub shaft integral with the rotor whilst the end plate 10 has a similar bore which accommodates a bearing 18 which supports the drive shaft 20 of the rotor. The drive shaft is connected to a drive coupling 22 by means of which the compressor may be connected to an external drive motor.

The drive coupling 22 carries two or more fan blades 24 and extending around the drive shaft 20 is a toroidal oil cooler 26. In use, the fan blades are rotated and suck air in through the toroidal cooler thereby cooling the lubricating oil flowing through it.

Extending through the end plate 12 of the stator is an inlet passage 28 within which is a non-return valve which comprises valve plate 30 cooperating with a valve seat 32. The inlet passage communicates with an inlet space defined by the end plate 12 and the separator casting 14. A single outlet passage 34 extends through the stator wall and communicates with a discharge pipe 36 which will be described in more detail below. Extending through the end plate 10 are one or more oil injection nozzles, indicated diagrammatically at 11 in FIG. 1, through which, in use, oil is injected into the compression cells sequentially.

Extending around the separator casting but spaced from it is an inlet cowl 38 which together with a plurality of ribs 40 on the separator casting defines a plurality of air inlet apertures and which is secured by means of screws 42 to a closure plate 44 which is connected to the separator casting and together with the separator casting defines a secondary separation space 46. Extending around the separator casting and retained in position by the inlet cowl 38 and by a peripheral flange 48 on the closure plate 44 is a part annular filter 50. The two ends of the filter 50 are connected together by means of a metal band 52 and associated screws 54. The space defined by the inlet cowl 38 and the closure plate 44 communicates with the inlet space defined by the separator casting 14 and the end plate 12 via the filter 50 and a plurality of holes or slots (not shown) formed in the separator casting.

The discharge tube 36 is screwed into the outlet 34 in the stator and communicates with a silencer which comprises an inner tube 56 extending around which is an outer tube 58. The inner tube 56 has a discontinuity 60 about 5 mm long formed in it and communicates with a primary separation space 62.

The primary separation space 62 is substantially enclosed and is defined on three sides by the separator casting and on the fourth side by an annular, radially extending baffle plate 64 which is spaced from the separator casting along its inner edge by a small clearance. The baffle plate 64 has one or more small apertures, such as at 13 formed in it which are displaced by 40° or more from the discharge tube 36.

The separator casting 14 contains a single, cylindrical, coalescing element or filter 66 which is secured in position by a single bolt 68 and, in this case, comprises microfine borosilicate glass fibres. The space within the filter 66 communicates with the space between the outer casing 2 and the stator 4 to the righthand side (as seen in FIG. 1) of the baffle plate 64 by means of a tube 70 having an open end 79.

The lower portion of the separator casting defines an oil collection space in which, in use, oil coalesced by the filter 66 collects. Extending between the oil collection space and the inlet space defined by the separator casting and the end plate 12 is a passageway 72 which is controlled by a non-return valve 74. The non-return valve 74 seals the oil collection space from the inlet space in normal operation of the compressor but is arranged to open progressively when the pressure within the separation space 46 exceeds a predetermined value, for instance 7 bar. The non-return valve is a simple spring loaded ball valve whose seat has one or more grooves or slots formed in it whose area is only of the order of 0.1 $mm^2$.

The lower portion of the outer casing 2 defines an oil sump 76 which communicates with the oil cooler 26 via a passage 78. The passage 78 contains a simple temperature-sensitive valve 80 which incorporates a temperature-sensitive element which is arranged to open the valve to permit oil to flow through it only when the temperature of the oil in the sump exceeds 70° C. Two further passageways, of which one is illustrated diagrammatically at 77 in FIG. 1, extend between the oil sump 76 and the two corners respectively between the end faces of the rotor and the stub shaft and drive shaft of the rotor so as, in use, to supply oil to the interior surfaces of the end plates and to the rotor bearings.

In use, the drive shaft is rotated and the volume of each compression cell sequentially increases whilst drawing in air through the inlet passage 28 and then decreases, at the end of which decrease the compressed air in each cell is discharged through the stator outlet 34. The air is drawn in through the gaps defined by the inlet cowl and the ribs 40 and then through the filter and then through the slots in the separator casting into the inlet space. During normal operation oil is supplied by virtue of the high pressure within the outer casing 2 both to the bearings and end faces of the rotor via the passages 77 and to the oil injection nozzles 11 via a passage 79. The oil pathway to the oil injection nozzles passes through the oil cooler 26 which is continuously cooled by virtue of the air drawn in through them from outside the compressor by the fan blades 24.

The compressed air with entrained oil droplets in it passes in to the silencer and by virtue of the discontinuity 60 in the inner tube 56 and the provision of the outer tube 58 the discharge from the stator is found to be effectively silenced. The compressed air then flows into the primary separation space 62 and impinges against the walls thereof. This impingement coupled with the fact that the compressed air is obliged to follow a tortuous path through the clearance between the baffle 64 and the separator casting or through the offset apertures in the baffle plate results in a majority of the entrained oil droplets being coalesced and dripping down around the separator casting into the sump. Having passed around the baffle 64 the compressed air then enters the pipe 70 and flows into the interior of the coalescing element 66 which removes the remainder of entrained oil droplets which drip down and collect in the oil collection space 46. The substantially oilfree compressed air then passes out through a compressor outlet (not shown) in the closure plate 44.

In normal operation, the non-return valve 74 remains closed but by virtue of the grooves in the seat of this valve there is a continual small leakage between the oil collection space and the inlet space. This amount of leakage is selected so as to be substantially equal to the rate at which the oil is coalesced by the coalescing element whereby the oil that collects in the collection space is returned to the compressor inlet and passes through the compressor in the usual manner. If the demand for compressed air should drop below the rate at which it is being compressed the pressure in the secondary separation space 46 will rise above its normal working value. In response to this rise in pressure the non-return valve 74 will open somewhat to return substantially that proportion of the compressed air which is not wanted back to the inlet space. This opening of the non-return valve 74 does of course immediately return any excess oil accumulated in the oil collection space.

If the compressor is started up from cold, the temperature of the oil in the sump will be less than the predetermined temperature and the temperature sensitive valve 80 will therefore be closed. This means that initially no oil is injected through the oil injectors. Oil is however supplied to the end plate and bearings and this small amount of oil coupled with the residual oil still in the stator is sufficient for lubrication and sealing purposes. However, due to the fact that no substantial volume of oil is being injected into the stator it and the air which is being compressed heat up very much more rapidly than is conventional. The compressed air and somewhat reduced volume of entrained oil then flow along the usual air pathway and, as mentioned above, that oil which is separated in the primary separation space 62 then trickles down over the outer surface of the separation casting, that is to say the secondary separation housing. This oil has a far higher thermal capacity than does air and the secondary separation housing is therefore very rapidly heated. By the time this oil reaches the sump it has given up the majority of its thermal energy and the oil in the sump therefore is initially scarcely heated. Once the rotor and stator have reached a temperature approaching their normal working temperature the secondary separation housing is then itself brought rapidly to a temperature approaching its normal working temperature by virtue of the hot oil flowing over its outer surface and it is only then that the oil in the sump begins to be significantly heated. This means that the airways within the compressor are brought to their normal operating temperature just as rapidly as possible thereby minimising the period of time during which condensation is liable to be formed within the compressor. Once the oil in the sump has reached a temperature of about 70° C. the temperature sensitive valve 80 opens and oil is then injected through the injection nozzles into the stator in the usual manner.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. A rotary air compressor of oil sealed type including a stator, a rotor within said stator, oil injection means arranged, in use, to inject oil into the interior of said stator, an oil sump, a first oil pathway, connecting said sump to said oil injection means, an oil cooler situated in said first oil pathway and a thermally responsive valve situated in said first oil pathway, said thermally responsive valve being arranged to open only when the temperature of said oil has reached a predetermined value, whereby, in use, no oil is injected through said oil injection means before the temperature of said oil has reached said predetermined value, said compressor including an outer casing which accommodates said stator and defines said sump and which includes primary and secondary oil separation means for removing, in use, substantially all the entrained oil from the compressed air, said primary separation means including one or more surfaces against which said compressed air leaving said stator is constrained to impinge whereby a proportion of said entrained oil is caused to coalesce and then drip downwardly towards said sump, said secondary separation means including at least one coalescing element through which said compressed air is constrained to pass whereby substantially the remainder of said entrained oil is caused to coalesce, said compressor further including a secondary separation housing which accommodates said at least one coalescing element and is arranged below at least a part of said primary separation means and is so situated that at least a proportion of said oil coalesced by said primary separation means runs down over the outer surface of said secondary separation housing, said primary separation means including an annular primary separation chamber extending around said secondary separation housing; said compressor further including an annular baffle plate extending around but not connected to said secondary separation housing, said annular baffle plate partially defining said primary separation chamber.

2. A compressor as claimed in claim 1 which is of eccentric rotor sliding vane type wherein said stator has two ends and two end plates closing said ends of said stator, said end plates defining respective apertures and carrying bearings within said apertures, said rotor being rotatably supported by said bearings, said compressor further including a second oil pathway extending from said sump to at least one of said bearings and the inner surfaces of said end plates, said second oil pathway being constructed and arranged to permit the flow of said oil therethrough substantially as soon as said compressor is started.

3. A compressor as claimed in claim 1 including a discharge pipe arranged to direct compressed air from said stator into said primary separation chamber and a further pipe arranged to direct compressed air to said secondary separation means, said further pipe having an open end on the side of said annular baffle plate which is remote from said primary separation chamber.

4. A compressor as claimed in claim 3 wherein said annular baffle plate defines one or more apertures which are circumferentially offset from said discharge pipe.

* * * * *